US006827844B2

(12) United States Patent
Gunnerman

(10) Patent No.: US 6,827,844 B2
(45) Date of Patent: Dec. 7, 2004

(54) ULTRASOUND-ASSISTED DESULFURIZATION OF FOSSIL FUELS IN THE PRESENCE OF DIALKYL ETHERS

(75) Inventor: Rudolf W. Gunnerman, Reno, NV (US)

(73) Assignee: SulphCo, Inc., Sparks, NV (US)

( * ) Notice: Subject to any disclaimer, the term of this patent is extended or adjusted under 35 U.S.C. 154(b) by 246 days.

(21) Appl. No.: 10/279,218

(22) Filed: Oct. 23, 2002

(65) Prior Publication Data

US 2004/0079680 A1 Apr. 29, 2004

(51) Int. Cl.[7] ..... C10G 29/22
(52) U.S. Cl. ..... 208/208 R; 208/157.15; 208/237; 208/240; 204/157.15
(58) Field of Search ..... 208/208 R, 157.15, 208/237, 240; 204/157.15

(56) References Cited

U.S. PATENT DOCUMENTS

| | | | | |
|---|---|---|---|---|
| 4,391,608 A | | 7/1983 | Dondelewski | |
| 4,725,287 A | | 2/1988 | Gregoli et al. | |
| 4,978,365 A | | 12/1990 | Gregoli et al. | |
| 5,000,872 A | | 3/1991 | Olah | |
| 5,110,443 A | | 5/1992 | Gregoli et al. | |
| 5,198,122 A | | 3/1993 | Koszalka et al. | |
| 5,753,102 A | | 5/1998 | Funakoshi et al. | |
| 5,824,214 A | | 10/1998 | Paul et al. | |
| 5,961,820 A | | 10/1999 | Jeanblanc et al. | |
| 6,402,939 B1 | * | 6/2002 | Yen et al. | 208/196 |
| 6,500,219 B1 | * | 12/2002 | Gunnerman | 44/904 |

FOREIGN PATENT DOCUMENTS

| | | |
|---|---|---|
| WO | WO 00/15734 | 3/2000 |
| WO | WO 02/074884 A1 | 6/2002 |

* cited by examiner

*Primary Examiner*—Walter D. Griffin
*Assistant Examiner*—James Arnold, Jr.
(74) *Attorney, Agent, or Firm*—M. Henry Heines; Townsend and Townsend and Crew LLP

(57) ABSTRACT

Fossil fuels are combined with an aqueous liquid and a dialkyl ether to form an aqueous-organic reaction medium which is passed through an ultrasound chamber on a continuous flow-through basis. The emerging mixture separates spontaneously into aqueous and organic phases, from which the organic phase is readily isolated as the desulfurized fossil fuel.

20 Claims, No Drawings

ULTRASOUND-ASSISTED DESULFURIZATION OF FOSSIL FUELS IN THE PRESENCE OF DIALKYL ETHERS

BACKGROUND OF THE INVENTION

1. Field of the Invention

This invention resides in the field of the desulfurization of petroleum and petroleum-based fuels.

2. Brief Summary of the Invention

Fossil fuels are the largest and most widely used source of power in the world, offering high efficiency, proven performance, and relatively low prices. There are many different types of fossil fuels, ranging from petroleum fractions to coal, tar sands, and shale oil, with uses ranging from consumer uses such as automotive engines and home heating to commercial uses such as boilers, furnaces, smelting units, and power plants.

Unfortunately, most fossil fuels contain sulfur, typically in the form of organic sulfur compounds. Sulfur causes corrosion in pipelines and in pumping and refining equipment, as well as the premature failure of combustion engines. Sulfur also poisons the catalysts used in the refining and combustion of fossil fuels. Due to its poisoning of the catalytic converters in automotive engines, sulfur is responsible in part for the emissions of oxides of nitrogen ($NO_x$) from diesel-powered trucks and buses. Sulfur is also responsible for the particulate emissions (soot) from trucks and buses since high-sulfur fuels tend to degrade the soot traps that are used on these vehicles. One of the greatest problems caused by sulfur compounds is their conversion to sulfur dioxide when the fuel is burned. When released to the atmosphere, sulfur dioxide results in acid rain which is harmful to agriculture, wildlife, and human health.

The Clean Air Act of 1964 and its subsequent amendments address the problem of sulfur in fossil fuels by imposing sulfur emission standards. Unfortunately, these standards are difficult and expensive to meet. Pursuant to the Act, the United States Environmental Protection Agency has set an upper limit on the sulfur content of diesel fuel of 15 parts per million by weight (ppmw), effective in mid-2006, a severe reduction from the standard of 500 ppmw as of the filing date of the present application. For reformulated gasoline, the EPA has lowered the standard to 30 ppmw, effective Jan. 1, 2004, as compared to 300 ppmw as of the filing date of this application. Similar changes have been enacted in the European Union, which will enforce a limit of 50 ppmw on the sulfur limit for both gasoline and diesel fuel in the year 2005.

Because of these regulatory actions, there is a continuing need for more effective desulfurization methods. The treatment of fuels to achieve sulfur emissions low enough to meet these requirements is difficult and expensive, and this inevitably results in increased fuel prices which have a major influence on the world economy.

The principal method of fossil fuel desulfurization in the prior art is hydrodesulfurization, a process in which the fossil fuel is reacted with hydrogen gas at elevated temperature and pressure in the presence of a catalyst. This causes the reduction of organic sulfur to gaseous $H_2S$, which is then oxidized to elemental sulfur by the Claus process. Unfortunately, a considerable amount of unreacted $H_2S$ remains, and this poses a serious threat to human health. Another difficulty with hydrodesulfurization is that when it is performed under the more stringent conditions needed to achieve the lower sulfur levels, there is an increased risk of hydrogen leakage through the walls of the reactor.

Hydrodesulfurization also has limitations in terms of the types of organic sulfur compounds that it can remove. Mercaptans, thioethers, and disulfides, for example, are relatively easy to remove by the process, while other sulfur-bearing organic compounds such as aromatic compounds, cyclic compounds, and condensed multicyclic compounds are more difficult. Thiophene, benzothiophene, dibenzothiophene, other condensed-ring thiophenes, and substituted versions of these compounds are particularly difficult to remove by hydrodesulfurization. These compounds account for as much as 40% of the total sulfur content of crude oils from the Middle East and 70% of the sulfur content of West Texas crude oil. The reaction conditions needed to remove these compounds are so harsh that attempts to remove them often cause degradation of the fuel itself, thereby lowering the quality of the fuel.

Of possible relevance to this invention are co-pending U.S. patent application Ser. No. 09/676,260, entitled "Oxidative Desulfurization of Fossil Fuels With Ultrasound," Teh Fu Yen et al., inventors, filed Sep. 28, 2000, co-pending U.S. patent application Ser. No. 09/812,390, entitled "Continuous Process for Oxidative Desulfurization of Fossil Fuels With Ultrasound and Products Thereof," Rudolf W. Gunnerman, inventor, filed Mar. 19, 2001, and co-pending U.S. patent application Ser. No. 09/863,127, entitled, "Treatment of Crude Oil Fractions, Fossil Fuels, and Products Thereof With Ultrasound," Rudolf W. Gunnerman et al., inventor, filed May 22, 2001. All three of these co-pending United States patent applications are incorporated herein by reference in their entirety for all legal purposes capable of being served thereby.

SUMMARY OF THE INVENTION

It has now been discovered that a fossil (i.e., petroleum-derived) fuel can be desulfurized by a continuous process that applies ultrasound to a multiphase reaction medium that contains the fuel, an aqueous fluid, and a dialkyl ether, the reaction medium spontaneously separating into aqueous and organic phases after the ultrasound treatment, thereby enabling the immediate recovery of the desulfurized fossil fuel as the organic phase by simple phase separation. The invention resides in a continuous flow-through system in which the fossil fuel, the aqueous fluid, and the dialkyl ether are fed as a multiphase aqueous-organic reaction medium to an ultrasound chamber in which ultrasound is applied to the mixture, and the reaction medium emerging from the chamber is allowed to settle into separate aqueous and organic phases. The organic phase then constitutes the desulfurized fuel which is readily removable from the aqueous phase by simple decantation. Unlike similar desulfurization processes of the prior art, this process achieves desulfurization without the addition of a hydroperoxide to either the fuel or the aqueous fluid.

The terms "desulfurized" and "sulfur-depleted" are used herein interchangeably, and both are intended to encompass fuels that contain no sulfur in any form, i.e., neither molecular sulfur nor organic or inorganic sulfur compounds, or so little sulfur that its level would be undetectable by conventional methods of detection. The terms "desulfurized" and "sulfur-depleted" are also used to include fuels whose sulfur content (either as molecular sulfur or as organic or inorganic sulfur compounds) is substantially reduced from that of the starting fossil fuel, and preferably to a level below any of the upper limits imposed or to be imposed by regulation as mentioned above.

Certain organic sulfur compounds that are typically present in fossil fuels are illustrative of the effectiveness of the process. These compounds are dibenzothiophene and related sulfur-bearing organic sulfides. These compounds are the most refractory organic sulfur compounds in fossil fuels. Although other explanations are possible, it is believed that these sulfides are converted to the corresponding sulfones by this process, the sulfones having greater solubility in the aqueous phase and therefore more readily removable by separation of the phases. The ultrasound-promoted reaction that occurs in the practice of this invention is selective toward the sulfur-bearing compounds of the fossil fuel, with little or no effect in the non-sulfur-bearing components of the fuel. The continuous flow-through nature of this invention permits a large quantity of fossil fuel to be treated at a modest operating cost and a low residence time in the ultrasound chamber. These and other advantages, features, applications and embodiments of the invention will be better understood from the description that follows.

DETAILED DESCRIPTION OF THE INVENTION

The term "liquid fossil fuels" is used herein to denote any carbonaceous liquid that is derived from petroleum, coal, or any other naturally occurring material and that is used to generate energy for any kind of use, including industrial uses, agricultural uses, commercial uses, governmental uses, and consumer uses. Included among these fuels are automotive fuels such as gasoline, diesel fuel, jet fuel, and rocket fuel, as well as petroleum residuum-based fuel oils including bunker fuels and residual fuels. Bunker fuels are heavy residual oils used as fuel by ships and industry and in large-scale heating installations. No. 6 fuel oil, which is also known as "Bunker C" fuel oil, is used in oil-fired power plants as the major fuel and is also used as a main propulsion fuel in deep draft vessels in the shipping industry. No. 4 fuel oil and No. 5 fuel oil are used to heat large buildings such as schools, apartment buildings, and office buildings, and large stationary marine engines. The heaviest fuel oil is the vacuum residuum from the fractional distillation, commonly referred to as "vacuum resid," with a boiling point of 565° C. and above, which is used as asphalt and coker feed. The present invention is useful in reducing the sulfur content of any of these fuels and fuel oils. In certain embodiments of the invention, the liquid fossil fuel is diesel fuel, either straight-run diesel fuel, rack diesel fuel (diesel fuel that is commercially available to consumers at gasoline stations), and blends of straight-run diesel and light cycle oil in volume ratios ranging from 50:50 to 90:10 (straight-run:light cycle oil).

The degree of sulfur depletion achieved by this invention will vary depending on the composition of the starting fuel, including the amount of total sulfur present in the fuel, and the forms in which the sulfur is present. The degree of sulfur depletion will also vary depending on the ultrasound conditions and whether or not the product is recycled to the ultrasound chamber before final recovery, and if so, the number of recycles performed. In most cases, the invention will result in a product fuel having a total sulfur content of less than 100 ppm by weight, preferably less than 50 ppm, more preferably less than 25 ppm, and most preferably less than 15 ppm (all by weight).

As noted above, many and possibly all of the desulfurized fuels produced by the process described herein demonstrate high ignition performance. For diesel fuels, the cetane index, also referred to in the art as the "cetane number," is a widely regarded measure of fuel performance, and the process of this invention can produce diesel fuels with a cetane index greater than 50.0, and in many cases greater than 60.0. This invention is capable of producing diesel fuels having a cetane index of from about 50.0 to about 80.0, and preferably from about 60.0 to about 70.0. The cetane index or number has the same meaning in this specification that it has among those skilled in the art of automotive fuels. Similar improvements are obtained in gasolines in terms of the octane rating.

As also noted above, many and possibly all of the products produced by this invention have a reduced API gravity. The term "API gravity" is used herein as it is among those skilled in the art of petroleum and petroleum-derived fuels. In general, the term represents a scale of measurement adopted by the American Petroleum Institute, the values on the scale decreasing as specific gravity values increase. The scale extends from 0.0 (equivalent to a specific gravity of 1.076) to 100.0 (equivalent to a specific gravity of 0.6112). In the case of diesel fuels treated in accordance with this invention, the API gravity of the product fuel is preferably greater than 30.0, and most preferably greater than 40.0. Otherwise expressed, the preferred API gravity of the diesel product is from about 30.0 to about 60.0, and most preferably from about 40.0 to about 50.0.

The aqueous fluid used in the process of this invention may be water or any aqueous solution. The relative amounts of liquid fossil fuel and water may vary, and although they may affect the efficiency of the process or the ease of handling the fluids, the relative amounts are not critical to this invention. In most cases, however, best results will be achieved when the volume ratio of fossil fuel to aqueous fluid is from about 8:1 to about 1:5, preferably from about 5:1 to about 1:1, and most preferably from about 4:1 to about 2:1.

The dialkyl ether used in the practice of this invention is one having a normal boiling point of at least 25° C. and can be either a cyclic ether or an acyclic ether, and is thus represented by the formula $R^1OR^2$ in which $R^1$ and $R^2$ are either separate monovalent alkyl groups or are combined into a single divalent alkyl group, in either case either saturated or unsaturated but preferably saturated. The term "alkyl" as used in this specification and the appended claims includes both saturated and unsaturated alkyl groups. Whether $R^1$ and $R^2$ are two separate monovalent groups or one combined divalent group, the total number of carbon atoms in $R^1$ and $R^2$ is from 3 to 7, preferably 3 to 6, and most preferably 4 to 6. In an alternative characterization, the dialkyl ether is one whose molecular weight is at most about 100. Examples of dialkyl ethers that would be preferred in the practice of this invention are diethyl ether, methyl tertiary-butyl ether, methyl-n-propyl ether, and methyl isopropyl ether. The most preferred is diethyl ether.

The amount of dialkyl ether used in the reaction mixture can vary and is not critical to the invention. In most cases, best results will be obtained with a volume ratio of ether to fossil fuel with the range of from about 0.00003 to about 0.003, and preferably within the range of from about 0.0001 to about 0.001. The dialkyl ether can be added directly to either the organic phase or the aqueous phase, but can also be first diluted in an appropriate solvent to facilitate the addition of the ether to either phase. In a presently preferred method, the ether is first dissolved in kerosene at 1 part by volume ether to 9 parts by volume kerosene, and the resulting solution is added to the fuel oil prior to placing the fuel oil in contact with the aqueous phase.

In certain embodiments of the invention, a metallic catalyst is included in the reaction system to promote the reaction. Examples of such catalysts are transition metal catalysts, and preferably metals having atomic numbers of 21 through 29, 39 through 47, and 57 through 79. Particularly preferred metals from this group are nickel, silver, tungsten (and tungstates), and combinations thereof. In certain systems within the scope of this invention, Fenton catalysts (ferrous salts) and metal ion catalysts in general such as iron (II), iron (III), copper (I), copper (II), chromium (III), chromium (VI), molybdenum, tungsten, and vanadium ions, are useful. Of these, iron (II), iron (III), copper (II), and tungsten catalysts are preferred. For some systems, such as crude oil, Fenton-type catalysts are preferred, while for others, such as diesel and other systems where dibenzothiophene is a prominent component, tungstates are preferred. Tungstates include tungstic acid, substituted tungstic acids such as phosphotungstic acid, and metal tungstates. The metallic catalyst when present will be used in a catalytically effective amount, which means any amount that will enhance the progress of the reaction (i.e., increase the reaction rate) toward the desired goal, particularly the oxidation of the sulfides to sulfones. The catalyst may be present as metal particles, pellets, screens, or other similar forms, retained in the ultrasound chamber by physical barriers or other restraining means as the reaction medium is allowed to pass through.

A further improvement in efficiency of the invention is often achievable by preheating the fossil fuel, the aqueous fluid, or both, prior to entry of these fluids into the ultrasound chamber. The degree of preheating is not critical and can vary widely, the optimal degree depending on the particular fossil fuel and the ratio of aqueous to organic phases. In general, best results will be obtained by preheating to a temperature within the range of from about 50° C. to about 100° C. For fuels with an API gravity of from about 20 to about 30, preheating is preferably done to a temperature of from about 50° C. to about 75° C., whereas for fuels with an API gravity of from about 8 to about 15, preheating is preferably done to a temperature of from about 85° C. to about 100° C. When preheating, care should be taken not to volatilize the fuel. The aqueous phase may be preheated to any temperature up to its boiling point.

Ultrasound used in accordance with this invention consists of soundlike waves whose frequency is above the range of normal human hearing, i.e., above 20 kHz (20,000 cycles per second). Ultrasonic energy with frequencies as high as 10 gigahertz (10,000,000,000 cycles per second) has been generated, but for the purposes of this invention, useful results will be achieved with frequencies within the range of from about 20 kHz to about 200 kHz, and preferably within the range of from about 20 kHz to about 50 kHz. Ultrasonic waves can be generated from mechanical, electrical, electromagnetic, or thermal energy sources. The intensity of the sonic energy may also vary widely. For the purposes of this invention, best results will generally be achieved with an intensity ranging from about 30 watts/cm$^2$ to about 300 watts/cm$^2$, or preferably from about 50 watts/cm$^2$ to about 100 watts/cm$^2$. The typical electromagnetic source is a magnetostrictive transducer which converts magnetic energy into ultrasonic energy by applying a strong alternating magnetic field to certain metals, alloys and ferrites. The typical electrical source is a piezoelectric transducer, which uses natural or synthetic single crystals (such as quartz) or ceramics (such as barium titanate or lead zirconate) and applies an alternating electrical voltage across opposite faces of the crystal or ceramic to cause an alternating expansion and contraction of crystal or ceramic at the impressed frequency. Ultrasound has wide applications in such areas as cleaning for the electronics, automotive, aircraft, and precision instruments industries, flow metering for closed systems such as coolants in nuclear power plants or for blood flow in the vascular system, materials testing, machining, soldering and welding, electronics, agriculture, oceanography, and medical imaging. The various methods of producing and applying ultrasonic energy, and commercial suppliers of ultrasound equipment, are well known among those skilled in ultrasound technology.

The residence time of the multiphase reaction medium in the ultrasound chamber is not critical to the practice or the success of the invention, and the optimal residence time will vary according to the type of fuel being treated. An advantage of the invention however is that effective and useful results can be achieved with a relatively short residence time. Best results will generally be obtained with residence times ranging from about 8 seconds to about 150 seconds. For fuels with API gravities of from about 20 to about 30, the preferred residence time is from about 8 seconds to about 20 seconds, whereas for fuels with API gravities of from about 8 to about 15, the preferred residence time is from about 100 seconds to about 150 seconds. Once the multiphase medium has left the ultrasound chamber, the phases are preferably allowed to separate immediately followed by immediate phase separation by decantation or other means.

Still further improvements in the efficiency and effectiveness of the process can be achieved by recycling the organic phase to the ultrasound chamber with a fresh supply of water. Recycle can be repeated for a total of three passes through the ultrasound chamber for even better results. Alternatively, the organic phase emerging from the ultrasound chamber can be subjected to a second stage ultrasound treatment in a separate chamber, and possibly a third stage ultrasound treatment in a third chamber, with a fresh supply of water to each chamber.

Although a large amount of sulfur compounds will have been extracted into the aqueous phase during the process of this invention, the organic phase emerging from the ultrasound chamber may contain residual amounts of sulfur compounds. A convenient way to remove these compounds is by conventional methods of extracting polar compounds from a non-polar liquid medium. Typical among these methods are solid-liquid extraction using adsorbents such as silica gel, activated alumina, polymeric resins, and zeolites. Liquid-liquid extraction can also be used, with polar solvents such as dimethyl formamide, N-methylpyrrolidone, or acetonitrile. A variety of organic solvents that are either immiscible or marginally miscible with the fossil fuel can be used. Toluene is one example.

The ultrasound generates heat, and with certain fossil fuels it is preferable to remove some of the generated heat to maintain control over the reaction. When gasoline is treated in accordance with this invention, for example, it s preferable to cool the reaction medium in the ultrasound chamber. Cooling is readily achievable by conventional means, such as the use of a liquid coolant jacket or a coolant circulating through the interior of the ultrasound chamber as for example in a cooling coil. Water at atmospheric pressure is an effective coolant for these purposes. When cooling is achieved by immersing the ultrasound chamber in a coolant bath or circulating coolant, the coolant may be at a temperature of about 50° C. or less, preferably about 20° C. or less, and more preferably within the range of from about −5° C. to about 20° C. Suitable cooling methods or devices will be readily apparent to those skilled in the art. Cooling is generally unnecessary with diesel fuel.

The following example is offered for purposes of illustration and are not intended to limit the scope of the invention.

EXAMPLE

A flow-through ultrasound chamber was used, containing an internal metal screen supporting a bed of solid metal catalyst consisting of a mixture of tungsten flakes and silver pellets, and positioned above the catalyst bed was an ultrasound probe whose lower end terminated approximately 5 cm above the catalyst bed. Ultrasound was supplied to the probe by an ultrasound generator as follows:

Supplier: Sonics & Materials, Inc., Newtown, Conn., USA

Power supply: net power output of 800 watts (run at 50%)

Voltage: 120 V, single phase

Current: 10 amps

Frequency: 20 kHz

Crude oil was combined with water at a 70:30 volume ratio, plus diethyl ether dissolved in kerosene at an ether-:kerosene volume ratio of 1:10; and a volume ratio of 1 part of the ether and kerosene mixture to 1,000 parts of the oil, again on a volume basis. The residence time of the two-phase mixture in the ultrasound chamber was approximately ten seconds, and the product mixture emerging from the chamber was separated into aqueous and organic phases. The organic phase was analyzed for sulfur on a sulfur analyzer Model SLFA-20, supplied by Horiba Instruments, Knoxville, Tenn., USA.

In tests using crude oil from Colorado and Wyoming containing 3.5% sulfur as the starting material, the sulfur content was reduced to 1.5% and 1.1%, respectively, in all cases on a weight basis.

For comparison, the same test was performed, using di-n-butyl ether in place of the diethyl ether. The sulfur content of the product oil was 3.4% by weight. This demonstrates the clear superiority of diethyl ether over di-n-butyl ether in the process of this invention.

The foregoing is offered primarily for purposes of illustration. Further variations in the materials, additives, operating conditions, and equipment that are still within the scope of the invention will be readily apparent to those skilled in the art.

What is claimed is:

1. A continuous process for removing sulfides from a liquid fossil fuel, said process comprising:

(a) combining said liquid fossil fuel with an aqueous fluid and a dialkyl ether having a normal boiling point of 25° C. or higher, said dialkyl ether having the formula $R^1OR^2$ in which $R^1$ and $R^2$ are either individual monovalent alkyl groups or together form a single divalent alkyl group and the total number of carbon atoms in $R^1$ and $R^2$ is from 3 to 7, to form a multiphase reaction medium;

(b) continuously passing said multiphase reaction medium through an ultrasound chamber in which ultrasound is applied to said multiphase reaction medium for a time sufficient to cause conversion of sulfides in said sulfide-containing liquid fossil fuel to sulfones;

(c) permitting said multiphase reaction medium upon emerging from said ultrasound chamber to separate spontaneously into aqueous and organic phases; and (d) isolating said organic phase from said aqueous phase, said organic phase thus isolated being said liquid fossil fuel with sulfides removed.

2. A process in accordance with claim 1 in which $R^1$ and $R^2$ are individual monovalent alkyl groups.

3. A process in accordance with claim 1 in which $R^1$ and $R^2$ are individual monovalent saturated alkyl groups.

4. A process in accordance with claim 1 in which $R^1$ and $R^2$ are individual monovalent saturated alkyl groups and the total number of carbon atoms in $R^1$ and $R^2$ is from 3 to 6.

5. A process in accordance with claim 1 in which $R^1$ and $R^2$ are individual monovalent saturated alkyl groups and the total number of carbon atoms in $R^1$ and $R^2$ is from 4 to 6.

6. A process in accordance with claim 1 in which said dialkyl ether is a member selected from the group consisting of diethyl ether, methyl tertiary-butyl ether, methyl-n-propyl ether, and methyl isopropyl ether.

7. A process in accordance with claim 1 in which said dialkyl ether is diethyl ether.

8. A process in accordance with claim 1 further comprising contacting said multiphase reaction medium with a transition metal catalyst during application of ultrasound.

9. A process in accordance with claim 8 further in which said transition metal catalyst is a member selected from the group consisting of metals having atomic numbers of 21 through 29, 39 through 47, and 57 through 79.

10. A process in accordance with claim 8 further in which said transition metal catalyst is a member selected from the group consisting of nickel, silver, tungsten, and combinations thereof.

11. A process in accordance with claim 1 in which step (a) comprises combining said liquid fossil fuel and said aqueous fluid at a (fossil fuel):(aqueous fluid) volume ratio of from about 8:1 to about 1:5.

12. A process in accordance with claim 1 in which step (a) comprises combining said liquid fossil fuel and said aqueous fluid at a (fossil fuel):(aqueous fluid) volume ratio of from about 5:1 to about 1:1.

13. A process in accordance with claim 1 in which step (a) comprises combining said liquid fossil fuel and said aqueous fluid at a (fossil fuel):(aqueous fluid) volume ratio of from about 4:1 to about 2:1.

14. A process in accordance with claim 6 in which the volume ratio of said dialkyl ether to said liquid fossil fuel is from about 0.00003 to about 0.003.

15. A process in accordance with claim 6 in which the volume ratio of said dialkyl ether to said liquid fossil fuel is from about 0.0001 to about 0.001.

16. A process in accordance with claim 1 in further comprising heating said fossil fuel to a temperature of from about 50° C. to about 100° C. prior to combining said fossil fuel with said aqueous fluid.

17. A process in accordance with claim 1 in which step (d) is performed within three minutes of the commencement of step (b).

18. A process in accordance with claim 1 in which step (d) is performed after a period of time ranging from about 8 seconds to about 150 seconds of the commencement of step (b).

19. A process in accordance with claim 1 in which said fossil fuel is a fuel having an API gravity of from about 20 to about 30, said process further comprises heating said fossil fuel to a temperature of from about 50° C. to about 75° C. prior to combining said fossil fuel with said aqueous fluid, and step (d) is performed after a period of time ranging from about 8 seconds to about 20 seconds of the commencement of step (b).

20. A process in accordance with claim 1 in which said fossil fuel is a fuel having an API gravity of from about 8 to about 15, said process further comprises heating said fossil fuel to a temperature of from about 85° C. to about 100° C. prior to combining said fossil fuel with said aqueous fluid, and step (d) is performed after a period of time ranging from about 100 seconds to about 150 seconds of the commencement of step (b).

* * * * *